250-506.1 SR
4/23/85 XR 4,513,205

United States Patent [19]
Splinter

[11] Patent Number: 4,513,205
[45] Date of Patent: Apr. 23, 1985

[54] INNER AND OUTER WASTE STORAGE VAULTS WITH LEAK-TESTING ACCESSIBILITY

[75] Inventor: Bob C. Splinter, Badhoevedorp, Netherlands

[73] Assignee: Peckson USA Corp., New Haven, Mich.

[21] Appl. No.: 465,192

[22] Filed: Feb. 9, 1983

[30] Foreign Application Priority Data

Jul. 28, 1982 [WO] PCT Int'l Appl. ..... PCT/NL82/00026

[51] Int. Cl.[3] ..... G21F 5/00
[52] U.S. Cl. ..... 250/507.1; 250/506.1
[58] Field of Search ..... 252/633, 630, 631, 632; 376/272, 250, 450; 250/507.1, 506.1

[56] References Cited

U.S. PATENT DOCUMENTS

| | | | |
|---|---|---|---|
| 3,142,648 | 7/1964 | Lefillatre et al. | 252/631 |
| 3,849,655 | 11/1974 | Martucci | 376/250 |
| 4,016,749 | 4/1977 | Wachter | 376/272 |
| 4,229,316 | 10/1980 | Baatz et al. | 252/633 |
| 4,252,667 | 2/1981 | Stegmaier et al. | 252/631 |
| 4,333,847 | 6/1982 | Tran et al. | 252/633 |

FOREIGN PATENT DOCUMENTS

| | | | |
|---|---|---|---|
| 1173998 | 7/1964 | Fed. Rep. of Germany | 252/633 |
| 501463 | 6/1977 | Japan | 252/633 |
| 2091477 | 12/1981 | United Kingdom | 252/633 |

*Primary Examiner*—Alfred E. Smith
*Assistant Examiner*—Richard Hanig
*Attorney, Agent, or Firm*—Barnes, Kisselle, Raisch, Choate, Whittemore & Hulbert

[57] ABSTRACT

A storage arrangement for waste materials of the type which tend to pollute the environment consisting of a waterproof reinforced concrete vault, preferably located underground, and a permanent reinforced concrete storage vault within the underground vault and spaced from the walls thereof by a water lock. Sealed containers filled with chemical or nuclear waste are deposited in the permanent storage vault and sealed therein with bitumen. The underground vault is provided with an access opening to the water lock to enable testing of the water periodically for contamination due to leakage from the permanent storage vault. If no leakage is evident after a predetermined time period has elapsed, the permanent storage vault is removed from the underground vault and shipped to a permanent storage site.

10 Claims, 3 Drawing Figures

INNER AND OUTER WASTE STORAGE VAULTS WITH LEAK-TESTING ACCESSIBILITY

This invention relates to a method and apparatus for storing waste material.

In recent years serious problems have arisen with respect to the safe, permanent disposal of waste materials of the type which tend to pollute the environment. Such materials include both nuclear wastes that produce various degrees of radioactive radiation, as well as wastes that tend to chemically pollute soil and water. Various types of containers and methods have been proposed heretofore for solving the problem of waste disposal. Some types of containers for such waste materials have achieved some degree of success, but there remains the possibility and danger than even some of the more reliable containers may develop leaks either when filled with the waste material which are not readily detectable or may develop leaks after a short or a prolonged period of storage.

It follows that a waste storage container, regardless of whether it is used for chemical waste or radioactive waste, must be designed so as to be structurally sound and leakproof indefinitely. It must be constructed of a material that is unaffected by the surrounding environment, whether it be water, salt, soil or air. A container for radioactive waste must, in addition, be constructed of materials that are at least resistant to the transmission of radioactive radiation.

The present invention has for its primary object the provision of a container for such waste materials designed to effectively seal such waste materials in a manner which prevents them from contaminating the environment.

Another object of this invention is to provide a method for temporarily storing such waste materials in a manner which insures that such waste filled containers are not subject to undetected leakage when disposed of for permanent storage.

A more specific object of this invention resides in the provision of a container for such waste materials which is designed to not only be structurally sound and moisture-proof for an indefinite period of time, but which at the same time is resistant to radioactive radiation to a high degree.

The primary feature of the invention resides in the storage of a waste-filled container for a predetermined time period within another container which provides a water lock that enables testing of the water periodically for contamination from the waste container so that the waste container can be removed to a permanent storage location in the event no leakage has occured or enables the container to be inspected so as to locate and repair the source of the leakage.

Other objects, features and advantages of the present invention will become apparent from the following description and accompanying drawings, in which.

Figure 1:
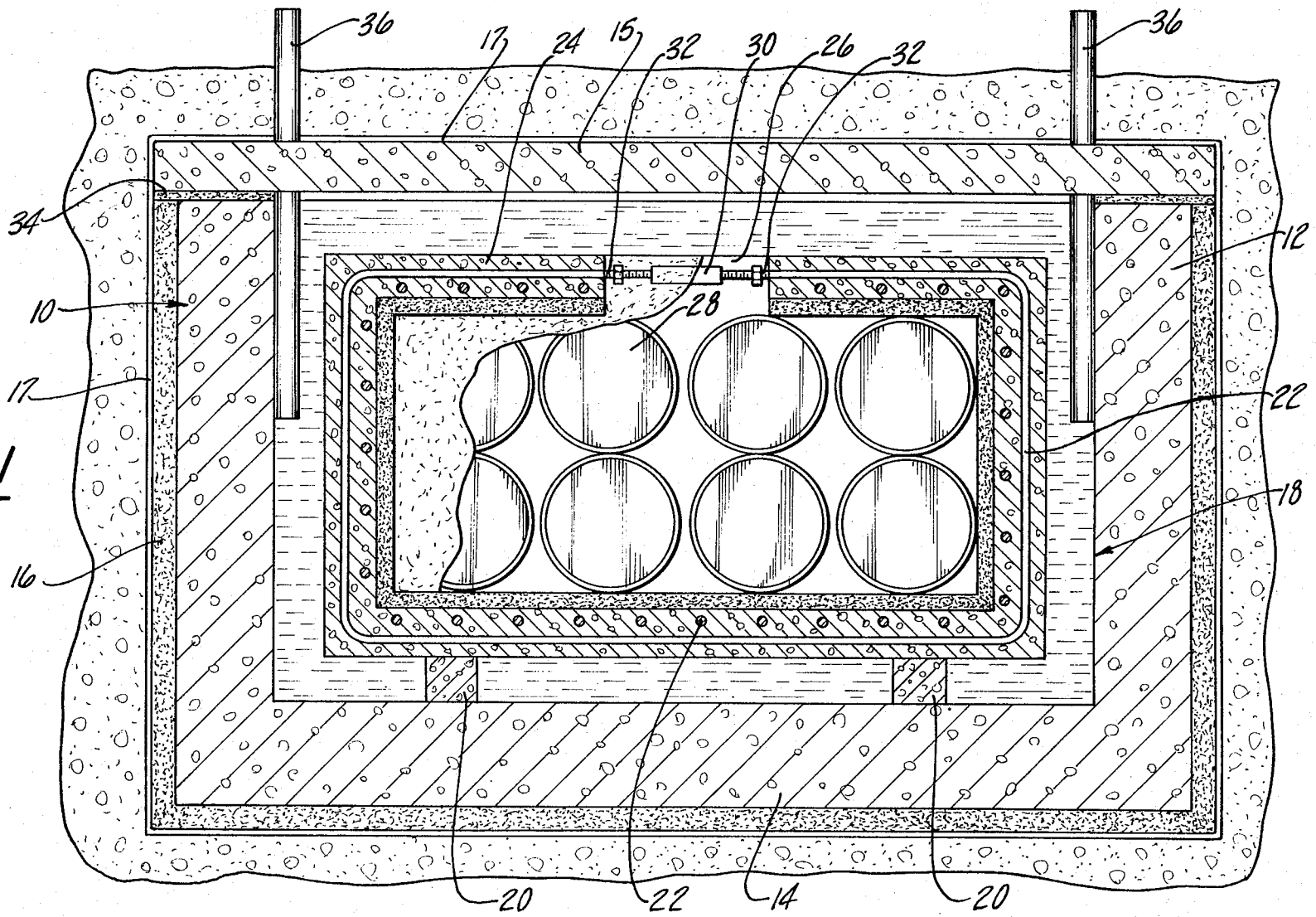
FIG. 1 is a vertical sectional view of a waste storage arrangement according to the present invention.

The arrangement shown in FIG. 1 includes a concrete vault generally designated 10 having side walls 12 and a bottom wall 14. The upper open end of vault 10 is adapted to be closed by a concrete cover 15. The walls of vault 10 are coated on the outside with a waterproofing material, such as a plastic resin and/or bitumen, to prevent seepage through the walls of the vault either inwardly or outwardly. In the embodiment illustrated in FIG. 1 the walls of the vault 10 are first coated with a layer of bitumen 16 and then overlaid with sheet plastic 17.

Bitumen is a solid or semi-solid material obtained as the asphaltic residue in the distillation of coal tar, wood tar, petroleum, etc. Its hardness depends upon the amount of oil which it contains. If all the oil is removed, bitumen is a hard solid substance referred to as pitch 100. If the bitumen is refined to the extent that it contains 20% oil, it is referred to as pitch 80. On the other hand, if pitch 80 is mixed with 15 to 20% oil and heated to about 300° to 400° C., the cooled product will contain substantially more than 20% oil and is referred to as pitch 50. The hardness of bitumen varies inversely with its oil content.

Referring again to FIG. 1, within vault 10 there is disposed a smaller concrete vault 18 which is dimensioned such that it can be placed within vault 10 on spacer blocks 20 so that the top, side and bottom walls of vault 18 are spaced from the corresponding walls of vault 10. Since vault 18 is used as a permanent storage for the waste, it is reinforced with a plurality of steel rods 22 which encircle the vault in all directions. The top wall 24 of vault 18 is formed with an access opening 26. After vault 18 is filled with the hereinafter described waste-filled containers 28, turn buckles 30 are arranged in opening 26 which extend to interconnect the opposed ends 32 of those rods 22 which extend to opening 26. Although the outer vault 10 is used primarily as a temporary storage and is preferably built or buried below ground, it is desirable to also reinforce this vault with steel rods (not shown) which encircle it horizontally.

The interior walls of vault 18 are coated with a hard bitumen, preferably pitch 80. This provides a hard, dense and durable coating around the inside of vault 18 which is leakproof and substantially unaffected by most chemical wastes. In addition, bitumen has the characteristic of resisting radioactive radiation.

Containers 28 are preferably in the form of steel barrels having a plastic resin lining so as to render them unaffected by the chemical or other waste materials placed therein. When a container 28 is filled with waste material, a conventional cover is sealingly clamped thereon and the whole container is then coated around its outside with a layer of pitch 80. A plurality of these filled and sealed containers are carefully placed, one at a time, in the inner vault 18 through access opening 26. If the inner vault 18 is of a size to accommodate a plurality of horizontally stacked rows of containers (two such rows are shown in FIG. 1), after the lower row is placed in the container soft bitumen (pitch 50) is heated to about 130° to 140° C. and poured into the vault 18 so that it covers the first layer or rows of containers 28. Thereafter a second layer or row of containers is deposited in vault 18 and, when the vault is filled with the desired number of containers, additional soft bitumen is poured into the vault and permitted to harden to a semi-solid state. The soft hot bitumen is poured into the vault so that it fills opening 26 and thereby effectively seals the entire contents of the vault 18. In the event the containers 28 contain a nuclear waste material, pieces of glass are dispersed throughout the bitumen as previously indicated.

After the vault 18 is sealed in the manner described, the space between the walls of vault 18 and 10 is filled with water or other suitable liquid that is adapted to be contaminated by any leakage from the inner vault 18. Cover 15 is then placed over the upper open end of vault 10 and sealed in place as at 34 by means of a suitable mastic or other water-proof adhesive. The cover 15 is then overlaid with a sheet of plastic, such as indicated at 17, which is sealed in a suitable manner to the sheet plastic surrounding vault 10.

The outer vault 10 is preferably located below ground level and, after cover 15 is sealed thereon, it is also covered with dirt. It should be pointed out, however, that each cover 15 has one or more pipes 36 extending vertically therethrough from a level above the ground downwardly into the water occupying the space between the two vaults. With this arrangement, after a vault 18 has been sealed in a vault 10 for a predetermined time period (which may vary from months to years depending upon the nature of the waste material stored in the containers 28), the water may be tested periodically for contamination by withdrawing a sample through a pipe 36 or by inserting a test instrument downwardly through the pipe. After a test period of predetermined duration is completed and no leakage is detected by testing the water, the soil over the outer vault is removed, cover 15 removed and inner vault 18 may be removed and transported to a permanent storage site or location which might be an underground pit, in the sea, a salt mine, etc.

As a practical matter a series of vaults 10 can be built in underground pits near a nuclear power plant or chemical facility which produces pollutant wastes. The successive vaults can be progressively filled with waste material and sealed as described and built in a number such that when the last vault 10 is filled the first one can be uncovered and the inner vault 18 can be removed therefrom and transported to a permanent storage site if no leakage has been detected. If, in the process of testing, it is determined that contamination of the water by either chemicals or radioactive radiation has been detected, the inner vault 18 can be inspected and, if practical, the leak repaired with the hard bitumen. The soft bitumen within vault 18 is of a semi-solid character such that it will flow into any cracks or crevices of the walls of vault 18. The use of soft bitumen is also desirable since it will absorb shocks and bumps to which the vault 18 may be subjected to when it is being transported by truck or otherwise to a permanent storage site. In the case of nuclear wastes, the location of a leak can be detected by a geiger counter or similar instrument. Depending on the nature of the waste material, the sealed vaults 18 can be simply buried underground to serve as a road base or a base for a parking surface. These sealed vaults can also be used as caissons for dikes and the like.

Figure 2:
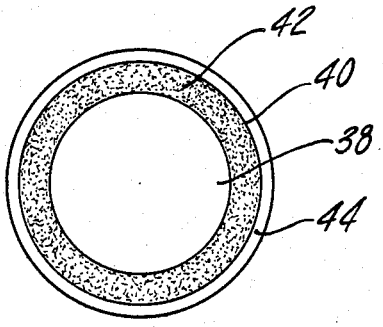
FIG. 2 is a sectional view of one form of waste container according to the present invention.

In the event that a barrel containing a waste becomes damaged prior to its placement in vault 18 or in the case of extra-hazardous wastes, the waste-filled barrel completely sealed (the barrel designated 38 in FIG. 2) can be encased in a larger undamaged barrel 40 with a layer 42 of bitumen therebetween. The outer barrel 40 is thereafter coated around its outer side with another layer 44 of bitumen, preferably the harder bitumen (pitch 80).

Figure 3:
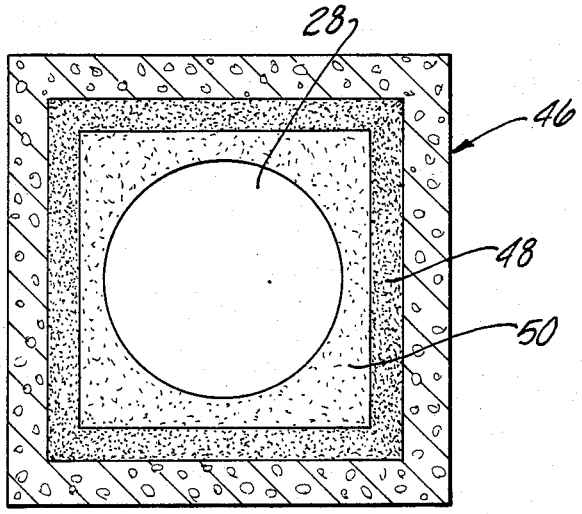
FIG. 3 is a sectional view of a permanent storage vault for a single waste container.

Certain types of both chemical and nuclear wastes are not accumulated rapidly in large amounts. Where the waste is of a type which accumulates rather slowly and it is not desired to prolong the filling of an inner vault 18 with numerous containers of such wastes, a smaller vault 46, such as shown in FIG. 3, can be used in place of a multi-container vault such as illustrated at 18 in FIG. 1. The construction of vault 46 is generally the same as vault 18; that is, it is steel reinforced concrete and provided with a sealable opening on one of its walls or the small vault 46 can be formed with an open end which is suitably closed and sealed to provide a structurally sound storage vault that will last indefinitely. As is the case of vault 18, vault 46 is lined with a layer 48 of hard bitumen and then the space between the container 28 and the hard bitumen layer 48 is filled with the softer bitumen. The outer surface of the inner vault and preferably the inner surface of the outer vault are not coated. A more durable concrete vault develops when these surfaces are in direct contact with water for a long period of time.

What is claimed is:

1. The method of storing waste material of the type that may pollute the environment which comprises sealing the waste materials in a container, placing the waste-filled container in a larger one-piece concrete permanent storage vault, said vault having an access opening therein to receive said container, filling the space between the walls of the container and the vault with bitumen through said access opening to completely seal the container within the vault, placing the permanent storage vault in a larger second concrete vault, the outer surfaces of which are coated with a liquid-proof material, the second vault having an open upper end closed by a cover sealed thereon, the first vault being placed in the second vault so that the top, bottom and side walls of the two vaults are spaced apart, filling said space between the two vaults with a liquid adapted to be contaminated by any waste material or radiation leaking through the walls of the permanent storage vault, sealing the second vault and providing an opening therein to said space to permit testing the liquid for contamination, and by means of said opening periodically testing the liquid for contamination.

2. The method called for in claim 1 including the step of removing the permanent storage vault from within the second vault after a predetermined liquid testing period has elasped wherein the liquid has not been contaminated and disposing said permanent storage vault into a permanent storage location.

3. The method called for in claim 2 wherein the bitumen is soft and flowable at ambient temperatures and said permanent storage vault is disposed of by bodily transporting it from the site of the second vault to a permanent disposal site.

4. The method called for in claim 1 including the step of removing the permanent storage vault from within the second vault if the liquid testing indicates contamination, repairing the defect which resulted in said leakage and thereafter again placing the permanent storage vault in the second vault as previously described for a further test period.

5. A system for storing waste materials of the type adapted to contaminate the environment comprising, one or more waste-filled sealed containers disposed within a one-piece concrete inner vault for permanent storage therein, said inner vault being disposed within a one-piece concrete outer container having a cover thereon, the inner vault having an access opening for receiving the sealed containers, the inner walls of the inner vault being lined with a layer of hard bitumen and being generally spaced from the walls of the sealed containers, the space between said layer of hard bitumen and the sealed containers being completely filled with a softer bitumen which is flowable at ambient temperature, said softer bitumen extending across and sealing said access opening, the outer walls of the outer vault being coated with a water proofing material to prevent seepage therethrough, the upper end of said outer vault providing an access opening closed by said cover, said cover being sealed over said access opening so that the outer vault completely seals the inner vault therein, the outer walls of the inner vault being spaced from the inner walls of the outer vault and the underside of said cover to form a sealed chamber in the outer vault surrounding the inner vault, said sealed chamber containing a fluid of the type to be contaminated by waste material or radiation that may leak through the walls of the inner vault, and an opening in the outer vault extending to said chamber and arranged to permit extraction of a sample of fluid from the sealed chamber or the insertion of a test instrument therethrough to enable testing the fluid to determine whether it has been contaminated as a result of said leakage, said cover being readily removable from the outer vault to permit removal of the permanent inner storage vault.

6. The system set forth in claim 5 wherein said permanent storage vault is reinforced with steel rods.

7. The system set forth in claim 6 wherein the ends of some of said access rods terminate at said opening in the permanent storage vault and removable tension means extend across said opening and interconnect the ends of said rods.

8. The system set forth in claim 5 wherein said container comprises an inner container and an outer container enclosing the inner container, the waste material being contained in the inner container, the walls of said two containers being spaced apart and the space therebetween being filled with bitumen.

9. The system set forth in claim 5 wherein the soft bitumen fills the access opening in the inner vault.

10. The system set forth in claim 5 wherein said waste-filled containers have a layer of hard bitumen around the outer sides thereof.

* * * * *